United States Patent [19]

Lampe, Jr.

[11] Patent Number: 4,725,792

[45] Date of Patent: Feb. 16, 1988

[54] WIDEBAND BALUN REALIZED BY EQUAL-POWER DIVIDER AND SHORT CIRCUIT STUBS

[75] Inventor: Ross W. Lampe, Jr., Maple Shade, N.J.

[73] Assignee: RCA Corporation, Princeton, N.J.

[21] Appl. No.: 845,553

[22] Filed: Mar. 28, 1986

[51] Int. Cl.[4] ..... H01P 5/10

[52] U.S. Cl. ..... 333/26; 333/128; 333/136

[58] Field of Search ..... 333/26, 100, 124, 125, 333/127, 128, 136

[56] References Cited

U.S. PATENT DOCUMENTS

| | | | |
|---|---|---|---|
| 2,238,438 | 4/1941 | Alford | 333/125 X |
| 2,897,456 | 7/1959 | Geppert | 333/127 |
| 3,245,009 | 4/1966 | Buschbeck | 333/26 |
| 4,204,168 | 5/1980 | Brown | 455/330 |
| 4,275,366 | 6/1981 | Schwarzmann | 333/161 |
| 4,460,877 | 4/1984 | Sterns | 333/26 |
| 4,484,163 | 11/1984 | de Ronde | 333/247 |

FOREIGN PATENT DOCUMENTS

| | | | |
|---|---|---|---|
| 2453605 | 5/1976 | Fed. Rep. of Germany | 333/128 |
| 2532120 | 2/1984 | France | 333/127 |

OTHER PUBLICATIONS

Jacques, Roger and Meignant, Didier, "Novel Wideband Microstrip Balun", *Proceeding of* 11*th European Microwave Conf.*, Amsterdam, Netherland, 7–11, Sep. 1981, pp. 839–843.

*Primary Examiner*—Eugene R. LaRoche
*Assistant Examiner*—Benny Lee
*Attorney, Agent, or Firm*—Clement A. Berard, Jr.; Raymond E. Smiley

[57] ABSTRACT

A balun comprises a one-to-two, equal-power, matched power divider having branch transmission lines whose lengths differ by ½ wavelength at a design frequency. The shorter of these two branch transmission lines has two ¼ wavelength long, shorted stub transmission lines branching therefrom ¼ wavelength apart.

10 Claims, 3 Drawing Figures

WIDEBAND BALUN REALIZED BY EQUAL-POWER DIVIDER AND SHORT CIRCUIT STUBS

The present invention relates to baluns for coupling unbalanced transmission lines to balanced transmission lines and relates more particularly to printed circuit baluns.

Many microwave circuits require that transitions be made between balanced and unbalanced transmission lines. A balun is one device which performs this function. A balun couples the signal at an unbalanced transmission line end to a balanced transmission line and by dividing the signal received at its unbalanced terminal equally to two balanced terminals and by providing the signal at one balanced terminal with a reference phase and the signal at the other balanced terminal with a phase equal to that reference phase plus or minus 180°. This 180° phase difference is normally provided by making the transmission line to one balanced terminal ½ wavelength longer than the transmission line to the other balanced terminal, all at the center frequency of the designed operating bandwidth of the balun. Since the difference in length, in wavelengths, of the transmission lines to the balanced terminals changes with frequency, the phase difference between the signals at the two balanced terminals deviates from 180° as the operating frequency deviates from that center frequency. This can be a significant problem for wideband signals. In a balun of this type in which a common transmission line from the unbalanced end and the transmission lines to the two balanced terminals all have the same characteristic impedance, the phase differential at the balanced terminals can vary from 180° by as much as ±25° across a 26% bandwidth (within which the VSWR at the unbalanced end is less than or equal to 1.2:1.)

There is a need for baluns which can maintain a phase differential of 180° within a few degrees (such as about ±2°) over such a substantial operating bandwidth.

SUMMARY OF THE INVENTION

A balun in accordance with the invention comprises a one-to-two, equal-power, matched power divider having two branch transmission lines whose lengths differ by ½ wavelength at a design frequency. The shorter of the two branch transmission lines is at least ¾ wavelength long and has two ¼ wavelength long, shorted, stub transmission lines branching therefrom ¼ wavelength apart.

DETAILED DESCRIPTION

Figure 1:
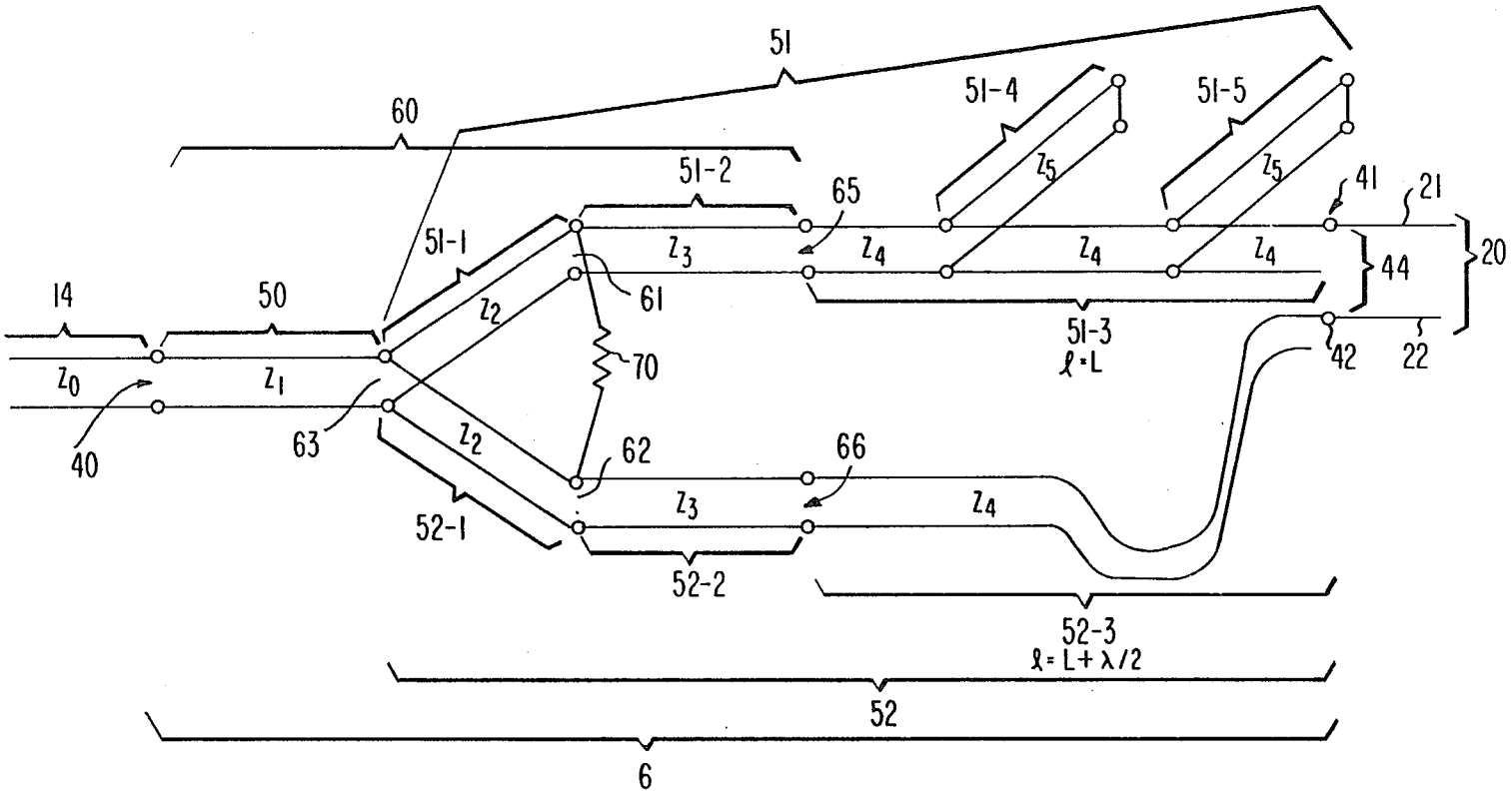
FIG. 1 is a schematic diagram of a balun in accordance with the present invention.

A transmission line balun 6 in accordance with the present invention is shown in schematic form in FIG. 1 where it has an unbalanced end or port 40 at the left hand side of the FIGURE and a balanced port 44 at the right hand side of the FIGURE. The unbalanced port

40 is connected to an unbalanced transmission line 14 having a characteristic impedance $Z_0$. The balanced port 44 comprises two terminals 41 and 42 which together form a balanced port which is connected to a balanced transmission line 20 having a characteristic impedance $2Z_4$.

The balun 6 is a one-to-two, equal-power, matched power divider having a common transmission line section 50 connected at a common junction 53 to first and second branch transmission lines 51 and 52, respectively. The common transmission line section 50 extends from the balun's unbalanced port 40 to the common junction 63, has a characteristic impedance $Z_1$ and is ¼ wavelength long at the design frequency.

Each of the branch transmission lines 51 and 52 comprises first, second and third sections connected in series, in that order, from the common junction 63 to a corresponding one of the terminals 41 and 42, respectively. The first section (51-1) of the first branch transmission line 51 connects to the second section (51-2) of the first branch transmission line 51 at a juncture 61. That second section (51-2) connects to the third section (51-3) of the first branch transmission line 51 at a juncture 65. The first section (52-1) of the second branch transmission line 52 connects to the second section (52-2) of the second branch transmission line 52 at a juncture 62. That second section (52-2) connects to the third section (52-3) of the second branch transmission line 52 at a juncture 66. The first section (51-1 or 52-1) of each branch transmission line has a characteristic impedance $Z_2$ and a length of substantially ¼ wavelength at the design frequency. The second section (51-2 or 52-2) of each branch transmission line has a characteristic impedance $Z_3$ and a length of substantially ¼ wavelength at the design frequency. A resistance 70 is connected between the juncture 61 and the juncture 62. Thus, the resistance 70 connects to each branch transmission line at a point which is ¼ wavelength from the common junction 63. The value of the resistance 70 is not critical, but is preferably made close to $2Z_0$.

The transmission line sections 50, 51-1, 51-2, 52-1 and 52-2 together with resistance 70 comprise an equal-power power divider 60 having quarter wave transformer sections (50, 51-2 and 52-2) of matching the input and output impedance of the power divider to the transmission line system within which it is connected. This power divider has a common port which is coincident with the unbalanced port 40 of the balun and branch ports which are coincident with the junctures 65 and 66 in the branch lines. The resistance 70 makes this power divider a matched divider since it serves to suppress odd mode signals.

The third section (51-3 or 52-3) of each branch transmission line has a characteristic impedance $Z_4$. The third section (51-3) of the first branch transmission line 51 has an arbitrary length L which is equal to or greater than ¼ wavelength at the design frequency. The third section (52-3) of the second branch transmission line 52 has a length of $L+\lambda/2$, where $\lambda$ is the wavelength in the transmission line of a signal at the design frequency. Together these third sections 51-3 and 52-3 serve to convert the equal phase outputs of divider 60 at the divider's branch ports (65 and 66) to a differential phase of 180° at the balanced port 44 of the balun.

Two stub transmission lines (51-4 and 51-5) branch from the third section 51-3 of the first branch transmission line 51. Each of these stub transmission lines has a characteristic impedance $Z_5$, is substantially ¼ wavelength long at the design frequency and is short circuited at its end remote from section 51-3. Shorted stub transmission line sections 51-4 and 51-5 comprise a double-stub tuner which compensates for the differences in phase slope with frequency of the sections 51-3 and 52-3 which result from their differing lengths.

The characteristic impedances of the transmission line sections are related in the following ways:

$Z_0$=the characteristic impedance of the transmission line 14 to which the unbalanced port of the balun is designed to connect, $Z_1=(\frac{1}{2})^{\frac{1}{4}}Z_0$ $Z_2=(2)^{\frac{1}{4}}Z_0$, $Z_3=(Z_0Z_4)^{\frac{1}{2}}$, $Z_4$=one half of the characteristic impedance of the two-conductor balanced transmission line 20 to (FIGS. 1 and 2) to which the balanced port of the balun is designed to connect, and $Z_5=(\frac{1}{2})Z_4$ For the case where $Z_4=Z_0$, this balun provides a theoretical 26% bandwidth where the limits of the band are defined as those points at which the VSWR on the common transmission 14 line reaches 1.2:1. This design provides a phase differential or 180±2° between the terminal 41 and the terminal 42 over this band and provides equal power to these two terminals within ±0.05 dB. For the case where $Z_4=2(Z_0)$ the bandwidth reduces to 20% and for $Z_4=3(Z_0)$ the bandwidth reduces to 16%. Within these reduced bandwidths, the phase differential and power division remain the same as it is when $Z_4=Z_0$.

In the absence of the double stub tuner comprised of sections 51-4 and 51-5, the phase differential over the band when $Z_4=Z_0$ is 180°±25°, when $Z_4=2(Z_0)$ the phase differential is 180°±18° and when $Z_4=3(Z_0)$ the phase differential is 180°±15°. Thus, the inclusion of the double stub tuner provides a substantial improvement in phase uniformity across the operating band.

Figure 2:
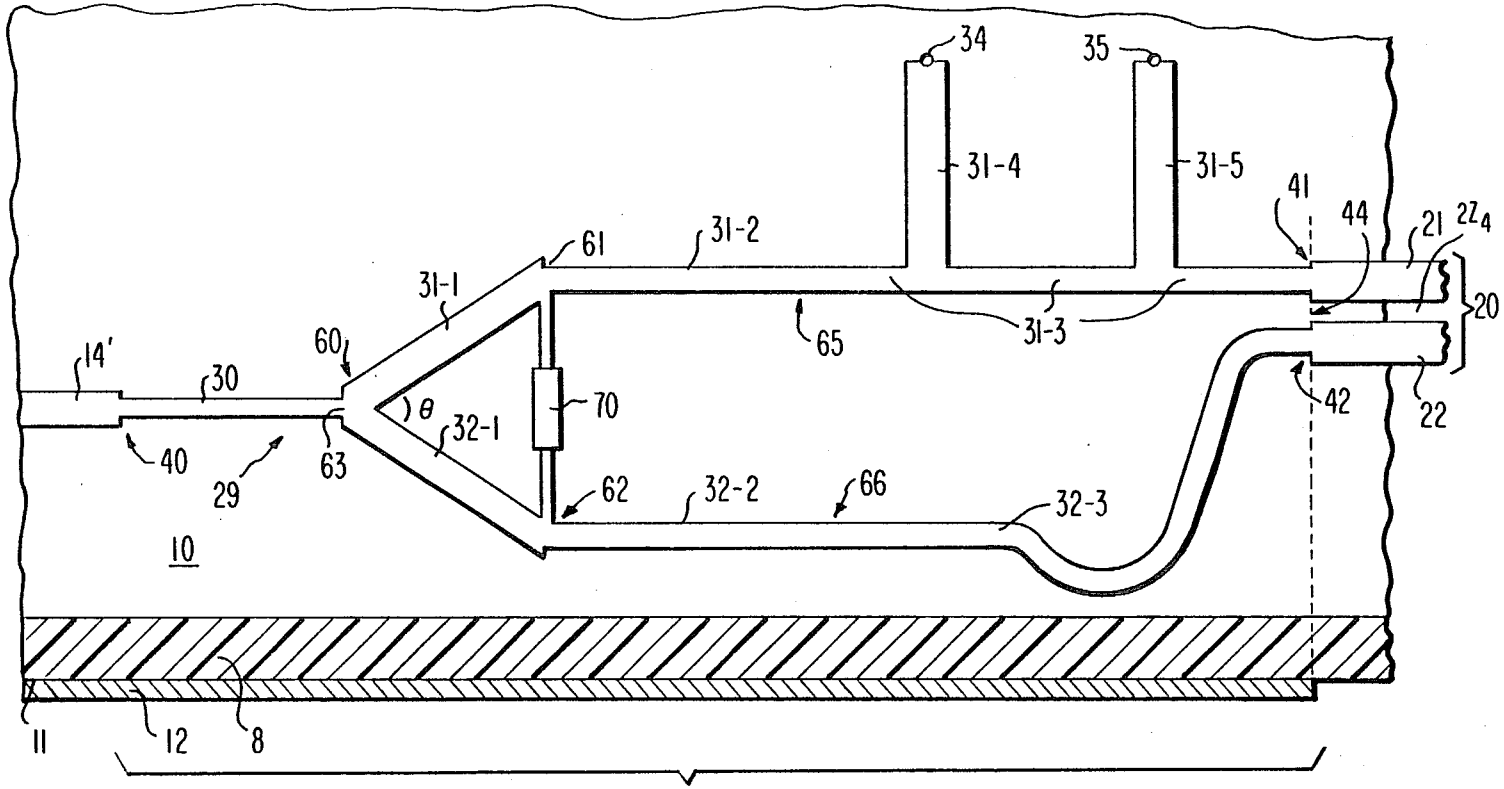
FIG. 2 is a perspective view of a microstrip balun in accordance with one embodiment of the present invention in which a balanced transmission line extends from the balanced terminal end of the balun.

FIG. 2 is a perspective view of a microstrip embodiment of the balun 6 of FIG. 1 in which $Z_0$=50 ohms and $Z_4$=50 ohms. This results in the following values for the various characteristic impedances:

$Z_0$=50 ohms, $Z_1$=42.04 ohms, $Z_2$=59.46 ohms, $Z_3$=50 ohms, $Z_4$=50 ohms, $Z_5$=25 ohms.

In FIG. 2, a dielectric substrate 8 has an upper major surface 10 and a lower major surface 11. The surfaces 10 and 11 are opposed and substantially parallel. A continuous ground conductor 12 is disposed on the lower major surface 11 except below the balanced transmission line 20 which connects to the balanced port 44. A relatively narrow strip conductor 29 disposed on the upper surface 10 of the substrate 8, the dielectric substrate 8 itself and the ground conductor 12 together comprise the unbalanced transmission line sections of the balun 6 as shown in FIG. 1.

The conductor 29 has sections 14', 30, 31-1, 31-2, 31-3, 31-4, 31-5, 32-1, 32-2, and 32-3, which respectively form the unbalanced transmission lines 14, 50, 51-1, 51-2, 51-3, 51-4, 51-5, 52-1, 52-2, and 52-3. Conductor 29 also includes sections 21 and 22 at the right of the FIGURE which together form the balanced transmission line 20.

Section 30 of the conductor 29 extends from balun unbalanced port 40 to common junction 63 and forms the common transmission line section 50. A section 30 has its width and length selected to provide the transmission line 50 with the desired value of 42 ohms for the characteristic impedance $Z_1$ and the desired length of $\frac{1}{4}$ wavelength at the design frequency (center frequency) of the balun. For a design frequency of 1000 MHz where the microstrip circuitry is formed on an alumina ($Al_2O_3$) substrate having a thickness of 0.050 inch and a dielectric constant of 10.0 the section 30 is made 0.067 inch wide and 1.11 inch long to provide its desired characteristic impedance of 42 ohms.

Sections 31-1 and 32-1 of strip conductor 29 which respectively form the transmission line sections 51-1 and 52-1 diverge at an angle Θ. Strip sections 31-1 and 31-2 are each 0.032 inch wide and 1.10 inch long to provide the desired characteristic impedance $Z_2$ of 59.5 ohms and the requried length of $\frac{1}{4}$ wavelength. The angle Θ between the conductor sections 31-1 and 32-1 is a matter of design choice and may preferably be on the order of 90°.

Sections 31-2 and 32-2 of strip conductor 29 are each 0.047 inch wide and 1.12 inch long to provide the desired characteristic impedance of 50 ohms for the transmission line sections 51-2 and 52-2 and to make them each $\frac{1}{4}$ wavelength long.

The strip conductor sections 31-3 and 32-3 are each made 0.047 inch wide to provide the desired characteristic impedance of 50 ohms. The length of the conductor section 31-3 is arbitrary, so long as it is at least $\frac{1}{4}$ wavelength (1.12) inch at the design frequency. For illustrative purposes, a length L of 2.25 inch is provided. In consequence, conductor section 32-3 has a length of 4.49 inch in order to be $\frac{1}{2}$ wavelength longer at the design frequency than the conductor section 31-3. The stub conductor sections 31-4 and 31-5 are each made 0.154 inch wide and 1.06 inch long to provide the corresponding transmission lines 51-4 and 51-5 with the desired characteristic impedance of 25 ohms and length of $\frac{1}{4}$ wavelength. Conductor sections 31-4 and 31-5 are short-circuited at their ends remote from section 31-3 by respective plated-through holes 34 and 35. The plating on the inner surfaces of these holes directly connects conductors 31-4 and 31-5 to the ground plane 12 thereby short circuiting the corresponding transmission line sections 51-4 and 51-5. The conductor sections 31-4 and 31-5 are spaced apart 1.12 inch along the conductor section 31-3 in order to be spaced apart by $\frac{1}{4}$ wavlength at the design frequency of 1000 MHz. The spacing of the conductor section 31-4 from the juncture of conductor sections 31-2 and 31-3 is arbitrary so long as that spacing allows conductor section 31-5 to be spaced from conductor section 31-4 by $\frac{1}{4}$ wavelength. In the illustrative embodiment, the conductor section 31-4 is spaced from the juncture 65 of conductor sections 31-2 and 31-3 by a distance of 1.55 inch.

Conductor sections 21 and 22 are made 0.10 inch wide and spaced 0.07 inch apart in order to provide transmission line 20 with its desired characteristic impedance of 100 ohms.

Figure 3:
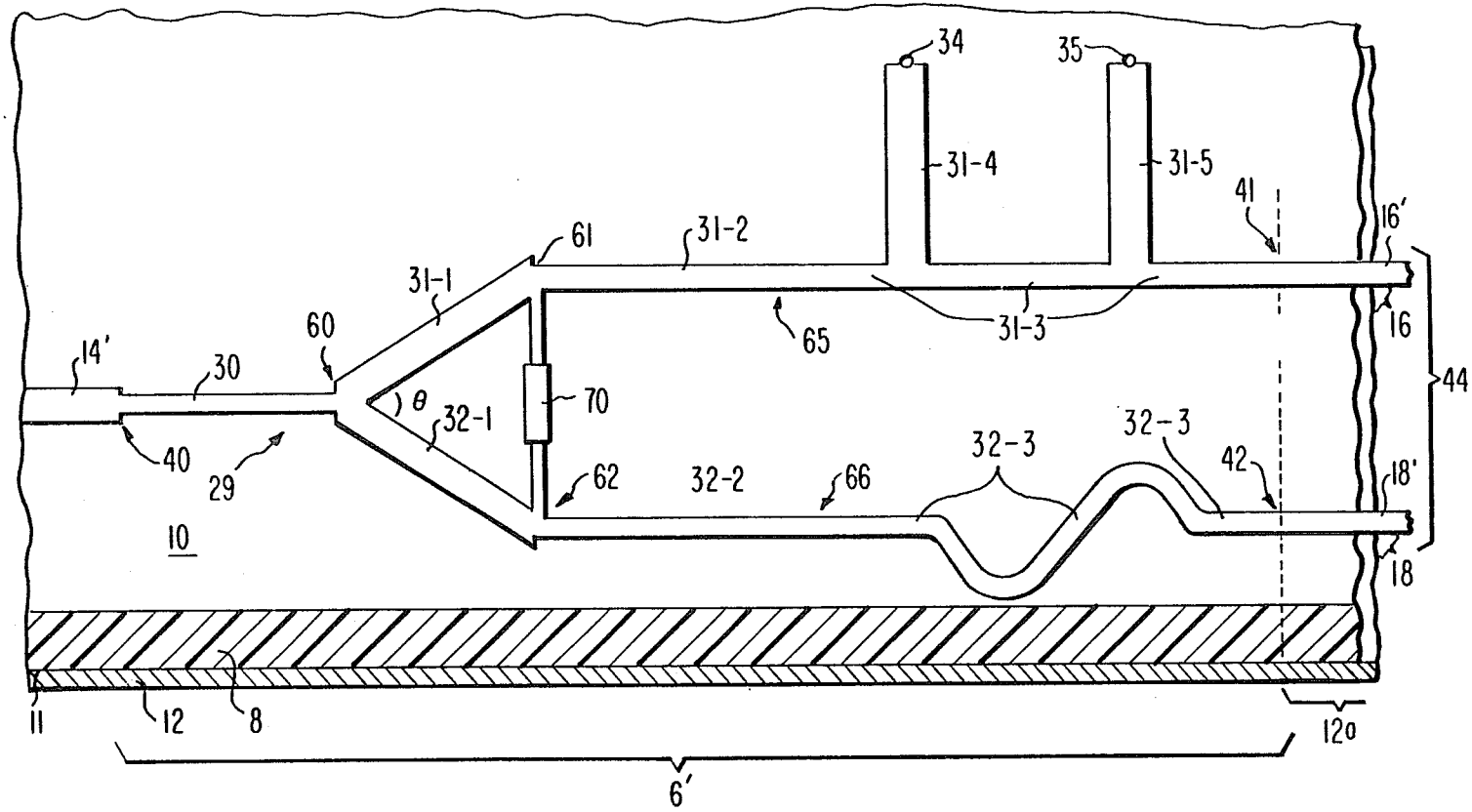
FIG. 3 illustrates the balun of FIG. 2 with a pair of unbalanced transmission lines extending from the balanced terminal end of the balun.

FIG. 3 illustrates an alternative or modified version 6' of the balun of FIG. 2 in which a pair of unbalanced transmission lines 16 and 18 are connected to the balanced port of the balun, one to each terminal with line 16 connected to terminal 41 and line 18 connected to terminal 42. The transmission lines 16 and 18 are formed respectively by sections 16' and 18' of conductor 29 with an extension 12a of the balun's ground plane on the lower surface of the substrate 8. Transmission lines 16 and 18 each have a characteristic impedance of $Z_4$ in order to match the third sections (51-3 and 52-3) of the branch transmission lines to which they connect. Conductor 16' connects directly to conductor section 31-3 and conductor 18' connects directly to conductor section 32-3.

A balun in accordance with the present invention is ideally suited to the microstrip embodiment illustrated and described with respect to FIGS. 2 and 3. However, it may be embodied in other transmission line media as may be required.

What is claimed is:

1. A balun, having an unbalanced port and a balanced port with first and second terminals, for converting between unbalanced and balanced signals, said balun comprising a one-to-two, equal-power, power divider having:

a common transmission line extending from said unbalanced port to a common junction;

a first branch transmission line extending from said common junction to said first terminal of said balanced port and a second branch transmission extending from said common junction to said second terminal of said balanced port, said branch transmission lines having lengths which differ by $\frac{1}{2}$ wavelength; and the shorter one of said branch transmission lines having two substantially $\frac{1}{4}$ wavelength long, short-circuited, stub transmission lines branching therefrom and spaced substantially $\frac{1}{4}$ wavelength apart, the one of said stub transmission lines which is closest to said common junction being at least substantially $\frac{1}{2}$ wavelength from said common junction;

wherein each of said lengths in wavelengths is measured at the same design frequency.

2. A balun, having an unbalanced port and a balanced port with first and second terminals, for converting between unbalanced and balanced signals, said balun comprising a one-to-two, equal-power, power divider having:

a common transmission line extending from said unbalanced port to a common junction;

a first branch transmission line extending from said common junction to said first terminal of said balanced port and a second branch transmission extending from said common junction to said second terminal of said balanced port, said branch transmission lines having lengths which differ by $\frac{1}{2}$ wavelength; and the shorter one of said branch transmission lines having two substantially $\frac{1}{4}$ wavelength long, short-circuited, stub transmission lines branching therefrom and spaced substantially $\frac{1}{4}$ wavelength apart, the one of said stub transmission lines which is closest to said common junction being at least substantially $\frac{1}{2}$ wavelength from said common junction;

each of said lengths in wavelengths is measured at the same design frequency;

said common transmission line and said first and second branch transmission lines, are unbalanced transmission lines;

said common transmission line is substantially $\frac{1}{4}$ wavelength long at said design frequency;

said first and second branch transmission lines each comprise first, second and third sections connected in series, in that order, from said common junction to said first and second terminals of said balanced port, respectively;

said first section of each of said branch transmission lines is substantially $\frac{1}{4}$ wavelength long at said design frequency;

said second sections of said branch transmission lines are each substantially $\frac{1}{4}$ wavelength long at said design frequency;

said third section of said first branch transmission line has an arbitrary length of at least $\frac{1}{4}$ wavelength at said design frequency;

said short-circuited stub transmission lines branch from said third section of said first branch transmission line; and said third section of said second branch transmission line is substantially $\frac{1}{2}$ wavelength longer than said third section of said first branch transmission line at said design frequency.

3. The balun recited in claim 2 wherein:

said common transmission line has a characteristic impedance of $Z_1$;

said first section of each of said branch transmission lines has a characteristic impedance of $Z_2$;

said second section of each of said branch transmission lines has a characteristic impedance of $Z_3$;

said third section of each of said branch transmission lines has a characteristic impedance of $Z_4$; and said shorted stub transmission lines have characteristic impedances of $Z_5$.

4. The balun recited in claim 3 wherein:

said unbalanced port of said balun connects to an unbalanced transmission line having a characteristic impedance of $Z_0$; and said impedances are related substantially as:

$Z_1=(\frac{1}{2})^{\frac{1}{2}}Z_0$ $Z_2=(2)^{\frac{1}{2}}Z_0$ $Z_3=(Z_0Z_4)^{\frac{1}{2}}$ and $Z_5=(\frac{1}{2})Z_4$.

5. The balun recited in claim 4 wherein:

said balanced port of said balun connects to a two conductor balanced transmission line which has a characteristic impedance of substantially $2Z_4$.

6. The balun recited in claim 4 wherein:

said first terminal of said balanced port of said balun connects to a second unbalanced transmission line having a characteristic impedance of $Z_4$;

said second terminal of said balanced port of said balun connects to a third unbalanced transmission line having a characteristic impedance of $Z_4$; and $Z_4$ substantially equals $Z_0$.

7. The balun recited in claim 2 wherein said balun is a printed circuit balun which further comprises:

a dielectric substrate having first and second major, opposed, substantially parallel surfaces;

a planar ground conductor disposed on said second surface of said substrate; and wherein said unbalanced transmission lines comprise a relatively narrow strip conductor disposed on said first surface of said substrate to form said unbalanced transmission lines together with said substrate and said ground conductor.

8. The balun recited in claim 3 wherein:

said balun is a printed circuit balun which further comprises:

a dielectric substrate having first and second major, opposed, substantialy parallel surfaces;

a planar ground conductor disposed on said second surface of said substrate;

wherein said unbalanced transmission lines comprise a relatively narrow strip conductor disposed on said first surface of said substrate to form said unbalanced transmission lines together with said substrate and said ground conductor;

said unbalanced end connects to an unbalanced transmission line having a characteristic impedance of $Z_0$; and said impedances are related substantially as:

$Z_1=(\frac{1}{2})^{\frac{1}{4}}Z_0$ $Z_2=(2)^{\frac{1}{4}}Z_0$ $Z_3=(Z_0Z_4)^{\frac{1}{2}}$ and $Z_5=(\frac{1}{2})Z_4$.

9. The balun recited in claim 8 wherein:

said balanced port of said balun connects to a two conductor balanced transmission line which has a characteristic impedance of substantially $2Z_4$.

10. The balun recited in claim 8 wherein:

said first terminal of said balanced port of said balun connects to a second unbalanced transmission line having a characteristic impedance $Z_4$;

said second terminal of said balanced port of said balun connects to a third unbalanced transmission line having a characteristic impedance $Z_4$; and $Z_4$ substantially equals $Z_0$.

* * * * *